United States Patent [19]

Davis

[11] Patent Number: 4,972,973

[45] Date of Patent: Nov. 27, 1990

[54] INSULATED CONTAINER FOR LIQUIDS

[75] Inventor: Philip Davis, Herts, United Kingdom

[73] Assignee: Burroughs Wellcome Co., Research Triangle Park, N.C.

[21] Appl. No.: 416,785

[22] Filed: Oct. 5, 1989

[30] Foreign Application Priority Data

Oct. 6, 1988 [GB] United Kingdom ..... 8823515

[51] Int. Cl.[5] ..... B67D 5/60

[52] U.S. Cl. ..... 222/131; 222/183; 222/377; 222/382; 222/464; 222/538

[58] Field of Search ..... 222/130, 131, 182, 183, 222/382, 192, 538, 539, 464, 321, 377, 372

[56] References Cited

U.S. PATENT DOCUMENTS

| | | | |
|---|---|---|---|
| 138,986 | 5/1873 | Banker | 222/183 |
| 1,530,074 | 3/1925 | Eckert | 222/382 X |
| 2,157,590 | 5/1939 | Cameron | 222/131 |
| 3,147,889 | 9/1964 | Dolgin | 222/131 |
| 3,171,571 | 3/1965 | Daniels | 222/131 X |
| 3,265,250 | 8/1966 | Meyer | 222/131 |
| 4,728,010 | 3/1988 | Johnston | 222/397 |
| 4,805,814 | 2/1989 | Allen, Sr. | 222/464 X |
| 4,844,300 | 7/1989 | Simons et al. | 222/131 X |

FOREIGN PATENT DOCUMENTS

| | | | |
|---|---|---|---|
| 0132145 | 1/1985 | European Pat. Off. . | |
| 2909449 | 9/1980 | Fed. Rep. of Germany | 222/215 |
| 99931 | 7/1923 | Switzerland | 222/538 |
| 506634 | 5/1939 | United Kingdom . | |

*Primary Examiner*—Kevin P. Shaver
*Attorney, Agent, or Firm*—Nixon & Vanderhye

[57] ABSTRACT

A container suitable for containing liquids, comprising an inner vessel, an opening out of which contents of the inner vessel may be dispensed, a closure for sealing the opening and a jacket of heat insulating material surrounding the inner vessel. A portion of the heat insulating material is movable from a closed position where it extends over the opening to an open position, substantially without exposing the inner vessel to the outside environment so as to enable the contents to be dispensed from the container. The container further comprises a dispensing tube which, in use, extends into the inner vessel and a recess in the insulating material in which the dispensing tube may be located when not in use.

9 Claims, 1 Drawing Sheet

INSULATED CONTAINER FOR LIQUIDS

The present invention relates to insulated containers which may be used to keep the contents warmer or colder than the surrounding environment.

EP-A-O 132 145 discloses an insulated container for solid pharmaceuticals, having insulation covering a stopper. GB-A-506 634 discloses insulating vessels for milk and other liquids, having a stop-cock located outside the insulation.

A problem with such containers is that it is difficult to minimise the heat transfer to the contents whilst still being able to gain access to the contents for the purpose of filling the container or, particularly, dispensing the contents later. The present invention provides an improved container.

According to one aspect of the invention, there is provided a container having an inner vessel, an opening out of which the contents may be dispensed, a closure for sealing the opening, and a surrounding jacket of heat insulating material, a portion of the heat insulating material being movable from a closed position where it extends over the opening to an open position, substantially without exposing the vessel to the outside environment, to enable the contents to be dispensed from the container, characterised in that the container is suitable for containing a liquid and additionally comprises (i) a dispensing tube which, in use, extends into the inner vessel and (ii) a recess in the insulating material in which the dispensing tube may be located when not in use.

Figure 1:
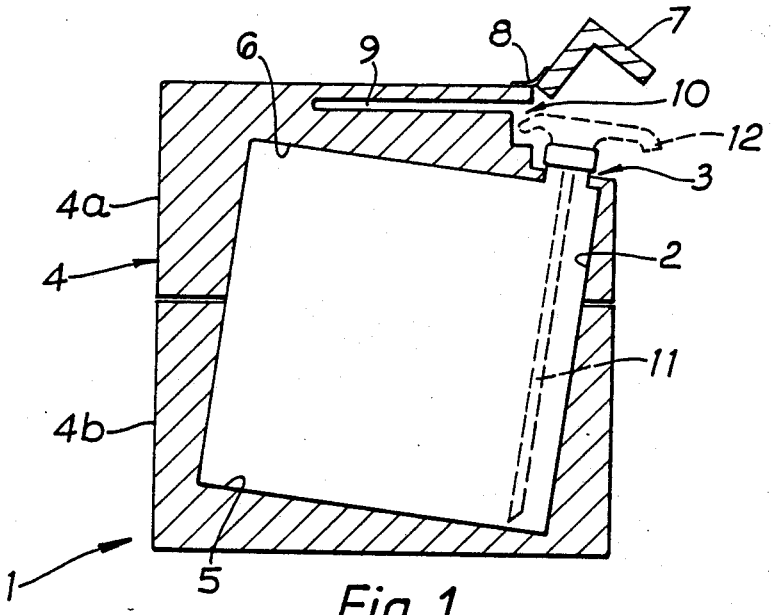
Figure 2:
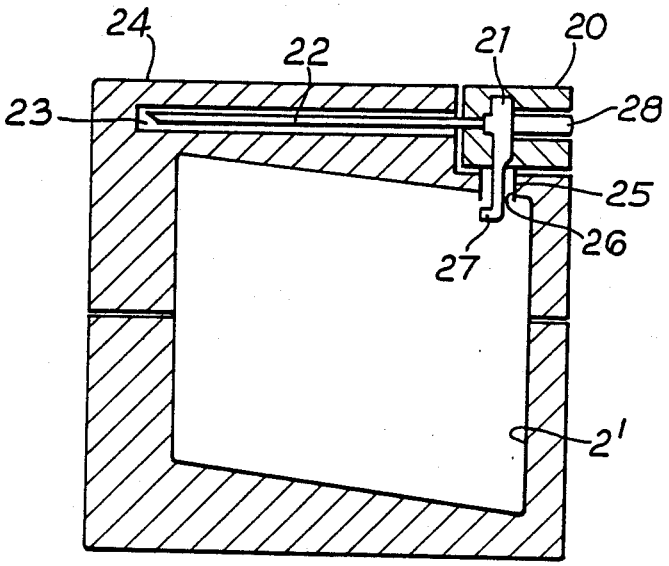

Preferred aspects of the invention will now be described by way of example and with reference to the accompanying drawings, in which:

FIG. 1 is a vertical section of a first container in accordance with the invention, showing in dotted outline a dispensing tube and pump in the operative position; and FIG. 2 is a vertical section through a second container in accordance with the invention, showing the dispensing tube and pump in the non-operative position.

The container 1 shown in FIG. 1 comprises an inner vessel 2 consisting of a generally cubic ten liter high-density polyethylene container provided with a 63 mm neck aperture 3 in the middle of one top edge thereof. Such a container is available from Plysu Limited, Woburn Sands, Bucks., UK. or from Blowmocan of Milton Keynes, UK.

The inner vessel 2 is surrounded by an approximately 3.8 cm thick expanded polystyrene jacket 4 which comprises an upper half 4*a* and a lower half 4*b*. The external shape of the jacket 4 is generally cubic. An appropriate cavity 5 is formed in the lower half 4*b* such that the inner vessel 2 may be snugly accommodated therein with the vertical axis of the inner vessel 2 inclined away from the vertical towards the middle of one of the top edges of the inner vessel 2 by about 20°.

The upper half 4*a* of the polystyrene jacket similarly has a cavity 6 so designed as to accommodate snugly the top half of the inner vessel 2. In addition, a lid portion 7 thereof in the middle of the upper edge adjacent the neck aperture 3 of the inner vessel 2 is formed with an inverted L-shaped vertical section and is hinged to the remainder of the upper half 4*a* of the polystyrene jacket 4 about a horizontal axis by means of a hinge 8 formed from a length of cloth insulating tape extending along the hinge axis generally parallel to the adjacent upper edge of the top half 4*a* of the jacket 4. The cloth insulating tape used for the hinge 8 is obtainable from Advance Tapes Limited, Leicester, UK. The lid portion 7 may be hinged from a closed position where it is aligned with the generally cubic exterior of the jacket 4 and in which it conceals the neck aperture 3 of the inner vessel 2 to an open position where the neck aperture 3 is exposed.

In the section of the polystyrene jacket 4 which lies above the inner vessel 2 there is a generally horizontal elongate recess 9 opening into a downwardly-extending mouth 10 which in turn opens into the space defined within the hinged portion 7 of the jacket 4 and adjacent the aperture 3 of the inner vessel 2.

Finally, FIG. 1 shows in dotted outline the operating position of a dispensing tube 11 and a manually-operated pump 12 which may be used to dispense the contents of the inner vessel 2. The pump 12 is adapted to engage the neck aperture 3 of the inner vessel and the dispensing tube then extends down into the inner vessel 2 to a location adjacent the bottom thereof. It can be seen that, because of the inclined orientation of the inner vessel 2 relative to the jacket 4, a small amount of liquid or powder contents within the inner vessel 2 will sink into the lowermost portion of the inner vessel 2 and can be pumped therefrom, thus enabling the maximum amount of the contents to be dispensed. The dispensing tube 11 is typically about 20 cm long and the pump and dispensing tube assembly is of a sort obtainable from Englass Limited, Leicester, UK.

In the embodiment shown in FIG. 1, the inner vessel 2 is substantially rigid, the upper and lower halves 4*a*, 4*b* of the polystyrene jacket 4 are also substantially rigid and are moulded into the form shown in FIG. 1. The container 1 is then assembled by placing the inner vessel 2 in the cavity 5 of the lower half 4*b* of the jacket 4 and then fitting the upper half 4*a* over the exposed upper portion of the inner vessel 2.

In an alternative embodiment (not shown), the inner vessel 2 is similarly substantially rigid but is placed within a mould cavity in the appropriate orientation and the expanded polystyrene jacket is formed integrally around the inner vessel 2 and therefore does not consist of the respective upper and lower halves 4*a*, 4*b*. In yet another embodiment, the polystyrene jacket is formed of two rigid halves 4*a*, 4*b* as shown in FIG. 1, but the inner vessel 2 is flexible and attains the shape shown in FIG. 1 only as a result of being filled with a fluid.

It is preferable, although not essential, for the expanded polystyrene jacket 4 to fit the inner vessel 2 snugly in the manner shown in FIG. 1. Alternatively, however, the outer jacket 4 is formed with a generally cubic cavity which is not inclined relative to the cube defined by the outer surface of the jacket 4. The inclination of the rigid inner vessel 2 is then achieved by placing at the bottom of the cavity 5 in the jacket 4 a wedge-shaped fitment on which the inner vessel 2 rests. It will be appreciated that, in such an embodiment, the inner vessel is not surrounded snugly by the jacket 4 and there are air spaces at some locations between the vessel and the jacket.

In all of these embodiments, the thickness of the polystyrene jacket 4 is adjusted according to the requirements for the container, in other words by reference to the temperature to which the container will be exposed, the temperature range which is appropriate for the contents of the container and the time during which the container, with its contents, is going to be exposed to the exterior temperature.

When the container 1 and its contents are being stored and one does not wish to dispense the contents, the pump 12 and dispensing tube 11 are disengaged from the neck aperture 3 of the inner vessel 2 and are accommodated within the recess 9,10 in the upper half 4a of the polystyrene jacket 4. A conventional sealing closure, for example a screw cap, is then used to close the neck aperture 3 of the inner vessel 2. The hinged portion 7 of the upper half 4a of the jacket 4 may then be moved down to the closed position, thus protecting the neck aperture and the pump 12 from external damage and also serving to provide additional heat insulation for the contents of the inner vessel 2. Without such a hinged portion 7, the rate of heat transfer between the exterior and the contents of the vessel 2 would be much greater.

FIG. 2 illustrates an embodiment which is similar to the embodiment shown in FIG. 1 and only the differences between the two embodiments will be described.

The portion 20 of the insulating jacket which may be moved between the storage position and a position in which the contents of the vessel may be dispensed, instead of being hinged as is the portion 7 in the FIG. 1 embodiment, is formed as a generally cuboid block surrounding the pump portion 21. In the storage position illustrated in FIG. 2, the dispensing tube 22 associated with pump 21 extends into a recess 23 in the polystyrene jacket 24 in a manner analogous to the FIG. 1 embodiment. On the lower surface of the removable portion 20 of the jacket 24, in the orientation shown in FIG. 2, there is a closure 25 adapted to engage and seal the neck aperture 26 of the inner vessel. The nozzle 27 of the pump 21 extends through the closure 25 into the vessel.

In order to dispense the contents of the vessel, the removable portion 20 of the jacket 24 is pulled out of position (which manoeuvre is facilitated if the dispensing tube 22 is flexible), rotated anti-clockwise through 90° about a horizontal axis (in the arrangement shown in FIG. 2) so that the dispensing tube 22 points downwardly, and then the dispensing tube 22 is inserted into the vessel in a manner analogous to that shown in FIG. 1. The pump 21 is then operated by pressing down on a movable portion 28 of the removable portion 20 of the jacket 24.

A further difference between the FIG. 2 and FIG. 1 embodiments is that the vessel of FIG. 2, although it has an inclined face, has vertical sides. This may be achieved either by providing an appropriately shaped rigid inner vessel 2' or by placing a flexible vessel 2' in an appropriate cavity of the casing 24 and expanding the vessel by filling it with a fluid.

In both of the FIG. 1 and FIG. 2 embodiments, the insulating jacket can be formed of materials other than expanded polystyrene, for example other foamed plastics materials such as polyurethane, beads of materials such as beads of expanded polystyrene, or loose fibrous materials such as mineral wool, glass wool, shredded paper or straw. One or more sheets of aluminium foil may be used to surround the inner vessel 2 or the jacket 4 in order to provide a reflective heat barrier.

A heat sink can be included, for example degraded collagen, preferably with a freezing point around the temperature of use such that the latent heat of freezing of the heat sink can be employed to provide further temperature stabilization for the contents of the vessel.

Since expanded polystyrene is quite friable, a protective outer jacket may be provided for the polystyrene jacket, for example a jacket of polythene sheet, cardboard or (for a more robust container) sheet metal.

The containers of the invention may be used to store and dispense any material which needs to be kept at a temperature other than the ambient temperature for a given period of time. Such materials include those which much be kept cooler than the surrounding atmosphere, such as pharmaceuticals (including vaccines), other chemicals and food. The containers have been found to be particularly suitable for storing and dispensing micro-encapsulated pesticides, especially for use in hot climates, since the storage life of the formulation is considerably lengthened if the temperature is kept between −5° and 15° C. The containers are also suitable for keeping contents hotter than the surrounding atmosphere, for example for storing and dispensing hot soup in cold climates.

I claim:

1. A container suitable for containing a liquid, said container comprising:

an inner vessel;

an opening out of which contents of said inner vessel may be dispensed;

a closure for sealing said opening;

a jacket of heat insulating material surrounding said inner vessel, a portion of said heat insulating material being movable from a closed position where it extends over said opening to an open position, substantially without exposing said inner vessel to the outside environment, to enable the contents to be dispensed from said inner vessel;

a dispensing tube which, in use, extends into said inner vessel; and a recess in said insulating material in which the dispensing tube may be located when not in use, said recess being concealed within said heat insulating material when said portion of said heat insulating material is in said closed position.

2. A container suitable for containing a liquid, said container comprising:

an inner vessel having an outer surface;

an opening out of which contents of said inner vessel may be dispensed;

a closure for sealing said opening;

a jacket of heat insulating material surrounding said inner vessel and in contact with said outer surface of said inner vessel, a portion of said heat insulating material being movable from a closed position where it extends over said opening to an open position, substantially without exposing said inner vessel to the outside environment, to enable the contents to be dispensed from said inner vessel;

a dispensing tube which, in use, extends into said inner vessel; and a recess in said insulating material in which said dispensing tube may be located when not in use.

3. A container according to claim 2, wherein the heat insulating material comprises expanded polystyrene.

4. A container according to claim 2, wherein said portion of heat insulating material is hinged to the remainder of the heat insulating material such that said portion may be swung away from said remainder in order to allow the closure to be removed and liquid to be dispensed from the container.

5. A container according to claim 2, wherein, when the container is standing in an upright position, the bottom surface of the vessel slopes to a lowermost portion.

6. A container according to claim 5, wherein, when the dispensing tube is in use, the bottom end thereof is adjacent said lowermost portion of the said bottom surface.

7. A container according to claim 2 additionally comprising a manually-operable pump for withdrawing liquid through the dispensing tube.

8. A container according to claim 7, wherein said pump and dispensing tube are accommodated in said recess in said heat insulating material when said pump and dispensing tube are not in use.

9. A container according to claim 8, wherein said recess is concealed within the heat insulating material when said portion thereof is in the closed position.

* * * * *